United States Patent [19]

Mitsui et al.

[11] Patent Number: 4,463,085

[45] Date of Patent: Jul. 31, 1984

[54] COLOR PHOTOGRAPHIC LIGHT-SENSITIVE MATERIAL

[75] Inventors: Akio Mitsui; Masakazu Morigaki, both of Kanagawa, Japan

[73] Assignee: Fuji Photo Film Co., Ltd., Kanagawa, Japan

[21] Appl. No.: 449,812

[22] Filed: Dec. 14, 1982

[30] Foreign Application Priority Data

Dec. 14, 1981 [JP] Japan ..... 201309/81

[51] Int. Cl.³ ..... G03C 7/40

[52] U.S. Cl. ..... 430/372; 430/387; 430/393; 430/504; 430/551; 430/555

[58] Field of Search ..... 430/372, 551, 393, 555, 430/504, 387

[56] References Cited

U.S. PATENT DOCUMENTS

| | | | |
|---|---|---|---|
| 4,015,990 | 4/1977 | Ishida et al. | 430/512 |
| 4,113,488 | 9/1978 | Yamada et al. | 430/372 |
| 4,268,593 | 5/1981 | Leppard et al. | 430/372 |

*Primary Examiner*—J. Travis Brown

*Attorney, Agent, or Firm*—Sughrue, Mion, Zinn, Macpeak & Seas

[57] ABSTRACT

A silver halide color photographic light-sensitive material comprising a support having coated thereon at least one silver halide emulsion layer, the color photographic light-sensitive material containing at least one kind of 2-equivalent magenta coupler represented by the following general formula (Ia):

(Ia)

wherein Ar represents phenyl substituted with at least one halogen, alkyl, alkoxy, alkoxycarbonyl or cyano; Y represents acylamino or anilino; and Z represents a group capable of being released by coupling, and at least one kind of piperidine compound represented by the following general formula (II):

(II)

wherein $R_1$ represents hydrogen or alkyl; $R_2$ represents alkyl, hydroxyalkyl, alkenyl alkynyl or benzyl; W represents hydrogen, alkyl, hydroxy, silyloxy, alkylamino, aryloxy, allyl, alkoxy, acylamino, sulfonamido, alkoxycarbonyl, carboxy, acyloxy or phosphoric acid oxy. The silver halide color photographic light-sensitive material can provide a good magenta color image without the occurrence of strain, even when the color photographic material is processed in a processing solution under the running condition.

22 Claims, No Drawings

COLOR PHOTOGRAPHIC LIGHT-SENSITIVE MATERIAL

CROSS REFERENCE

The present application is related to our copending application entitled "COLOR PHOTOGRAPHIC LIGHT-SENSITIVE MATERIAL" which was filed on the same date of the present application and is based on Japanese Patent Application No. 56-204447 and claims priority based on that application as of Dec. 16, 1981.

FIELD OF THE INVENTION

The present invention relates to a color photographic light-sensitive material containing a 2-equivalent magenta coupler and, particularly, to a method for prevention of stain which occurs during development processing of a color photographic light-sensitive material containing a 2-equivalent magenta coupler.

BACKGROUND OF THE INVENTION

Various pyrazolone derivatives are known as magenta dye forming couplers (hereinafter referred to as a magenta coupler). However, pyrazolone derivatives generally used for photographic light-sensitive materials are 4-equivalent couplers. Such compounds theoretically require the development of 4 moles of silver halide for forming 1 mole of a dye by reacting with an aromatic primary amine developing agent. On the contrary, pyrazolones having an active methylene group substituted by a group which can be released by oxidative coupling with an oxidation product of the primary amine developing agent require development of only 2 moles of silver halide. In addition, the 4-equivalent pyrazolone derivatives have a low color forming efficiency (conversion of the coupler into the dye) and generally form only a ½ mole or so of the dye per mole of the coupler.

As a means for improving the color forming efficiency by decreasing the amount of silver halide required for development, utilization of 2-equivalent pyrazolone magenta couplers has been proposed. Examples of pyrazolone derivatives which release an oxygen atom include compounds having an aryloxy group in the 4-position of 5-pyrazolone as described in U.S. Pat. No. 3,419,391 and compounds having an alkyloxy group as described in Japanese Patent Publication No. 46453/78.

Examples of pyrazolone derivatives which release a nitrogen atom include compounds having an imidazolyl group, a pyrazolyl group or a triazolyl group in the 4-position of 5-pyrazolone as described in U.S. Pat. Nos. 4,076,533 and 4,241,168, compounds having a pyridonyl group or a 2-oxopiperidinyl group as described in U.S. Pat. No. 4,220,470 and compounds having a sulfonamido group as described in U.S. Pat. No. 4,237,217.

Further, examples of pyrazolone derivatives which release a sulfur atom include compounds having a heterocyclic thio group or an arylthio group in the 4-position of 5-pyrazolone as described in U.S. Pat. Nos. 3,227,554 and 4,263,723, Japanese Patent Publication No. 34044/78, compounds having a thiocyano group as described in U.S. Pat. No. 3,214,437 and compounds having a dithio-carbamate group as described in U.S. Pat. No. 4,032,346. These compounds are advantageous in that most of them can be synthesized from 4-equivalent pyrazolones by one step. Also, these compounds are advantageous in view of photographic sensitivity and equivalency. It has been found that compounds having a 2-alkoxyarylthio group in the 4-position of 5-pyrazolone have exceptionally superior properties among couplers of the type which release an arylthio group. In addition, magenta color images formed from the couplers having a 2-alkoxyarylthio group have good fastness to light, while the light fastness of magenta color images formed from conventional couples having an arylthio group is remarkably inferior.

However, these 2-equivalent magenta couplers do not sufficiently eliminate stains (increase in color density in unexposed areas) which are formed by development processing.

The stains occurring in unexposed areas of silver halide color photographic light-sensitive material are undesirable and are a determining factor with respect to whether whiteness of the non-image areas is good or bad. Further, the stains adversely affect the color turbidity of the images and injure the visual sharpness of the images. Particularly, in case of reflective photographic materials, for example, photographic color papers, the reflective density of the stains is theoretically emphasized several times that of the transmission density. Therefore, the stains are very important factors since a slight degree of stain still injures the image quality.

The stains in the silver halide color photographic light-sensitive materials are roughly classified into four groups depending on the cause of the stain. First is a stain which is formed after the production of the photographic light-sensitive material and before the processing thereof due to heat or humidity. Second is a stain caused by the development fog of the silver halide. Third is a stain based on color contamination due to color couplers in a development processing solution (for example, aerial fog, etc.) or a stain due to a dye formed by the reaction with a coupler of an oxidized developing agent which is formed by oxidation of a developing agent remaining in the silver halide emulsion layer by a bleach solution or oxygen in the air, etc. (for example, bleaching stain, etc.). Fourth is a stain based on changes in photographic materials after development processing with the passage of time due to light, humidity or heat. The present invention relates to stains due to the development processing of photographic materials containing 2-equivalent magenta couplers, i.e., the present invention relates to the third and fourth types of stains described above.

It is unusual to prepare a new solution for the development processing after every development processing. In practice, the solution is replenished by adding a replenishing developing solution in an amount which depends on the amount of photographic materials developed. However, the composition of the solution can not be maintained merely by adding components which are consumed by development.

In general, solutions for development processing include a color developing solution, a stopping solution, a bleaching solution, a fixing solution or a bleach-fixing (blixing) solution, etc. Since the processing temperature is maintained at a high temperature such as from 31° C. to 43° C., the compositions of the processing solutions can be changed by several factors. For example, components such as the developing agent, etc., is subjected to decomposition for a long period of time or to oxidation when brought in contact with the air. It is also possible for the components contained in the photographic light-sensitive materials to be dissolved out and accumulated in the solution during the processing of the photographic light-sensitive materials. In addition, the processing solution may be taken into the following bath by becoming attached to the photographic material. Thus, the processing solution becomes a so-called running solution. To eliminate such problems, a replenishment procedure in which chemicals lacked are supplementarily added to the solution and a regeneration procedure in which undesirable components are removed are carried out, but they are still incomplete.

The photographic light-sensitive materials containing 2-equivalent magenta couplers have a large tendency to form stains in the running solution. However, the occurrence of such stains cannot be prevented by techniques heretofore known. An example of an effective method for preventing such stains involves the incorporation of a reducing agent, particularly, an alkylhydroquinone (for example, those as described in U.S. Pat. Nos. 3,935,016 and 3,960,570) into a photographic light-sensitive material, particularly, an emulsion layer wherein the stains are formed. It is also known that a chroman, a coumaran (for example, those as described in U.S. Pat. No. 2,360,290), a phenol type compound (for example, those as described in Japanese Patent Application (OPI) No. 9449/76 (the term "OPI" as used herein refers to a "published unexamined Japanese patent application")), etc., are effective. Furthermore, a sulfinic acid type polymer is known as being effective as described in Japanese Patent Application (OPI) No. 151937/81. However, these known techniques cannot provide a sufficiently good effect against processing stain due to 2-equivalent magenta couplers, in particular, the processing stain owing to the exhausted solution, even though some effect is obtained.

SUMMARY OF THE INVENTION

An object of the present invention is, therefore, to provide a method for preventing the occurrence of stain when a photographic light-sensitive material containing a 2-equivalent magenta coupler is subjected to development processing, and particularly, a method for completely preventing the occurrence of stain in a solution for development processing under the running condition.

Another object of the present invention is to provide a photographic light-sensitive material in which a 2-equivalent magenta coupler is used and the amount of silver contained is reduced and good sharpness is obtained as a result of the development processing.

Other objects of the present invention will become apparent from the following detailed description and examples.

The above-described objects of the present invention can be attained by a silver halide color photographic light-sensitive material comprising a support having coated thereon at least one silver halide emulsion layer, the color photographic light-sensitive material having at least one layer containing at least one kind of 5-pyrazolone type 2-equivalent magenta coupler represented by the following general formula (Ia):

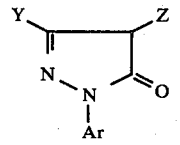

(Ia)

wherein Ar represents a phenyl group substituted with at least one halogen atom, an alkyl group having 1 to 22 carbon atoms, an alkoxy group having 1 to 22 carbon atoms, an alkoxycarbonyl group having 2 to 22 carbon atoms, or a cyano group; Y represents an acylamino group having 1 to 32 carbon atoms, or an anilino group having 6 to 44 carbon atoms; and Z represents a group capable of being released by coupling, and at least one kind of piperidine compound represented by the following general formula (II):

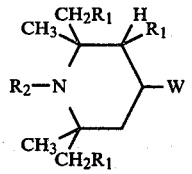

(II)

wherein $R_1$ represents a hydrogen atom or an alkyl group having from 1 to 4 carbon atoms; $R_2$ represents an alkyl group having from 1 to 12 carbon atoms, a hydroxyalkyl group having from 1 to 12 carbon atoms, an alkenyl group having from 3 to 4 carbon atoms, an alkynyl group having from 3 to 4 carbon atoms or a benzyl group; W represents a hydrogen atom, an alkyl group having 1 to 22 carbon atoms, a hydroxy group, a silyloxy group, an alkylamino group having 1 to 22 carbon atoms, an aryloxy group having 6 to 22 carbon atoms, an allyl group, an alkoxy group having 1 to 22 carbon atoms, an acylamino group having 1 to 22 carbon atoms, a sulfonamido group having 1 to 22 carbon atoms, an alkoxycarbonyl group having 2 to 22 carbon atoms, a carboxy group, an acyloxy group having 1 to 22 carbon atoms or a phosphoric acid oxy group.

DETAILED DESCRIPTION OF THE INVENTION

In the general formula (Ia), the group capable of being released by coupling represented by Z include, for example, a halogen atom, a group releasing an oxygen atom, a group releasing a nitrogen atom or a group releasing a sulfur atom.

Of the compounds represented by the general formula (Ia), those having a group releasing a nitrogen atom or a group releasing a sulfur atom as the group capable of being released represented by Z are preferred in view of the color forming property and the stability of the coupler compounds. On the other hand, the compounds having a halogen atom as the group capable of being released have a disadvantage in that color formation without accompanying development of silver (the so-called fog) are remarkable. Further, the compounds having a group releasing an oxygen atom as the group capable of being released have disadvantages in that they are synthesized by complicated steps and in that they have an inferior color forming property.

Of the compounds represented by the general formula (Ia), preferred compounds can be represented by the following general formula (Ib):

(Ib)

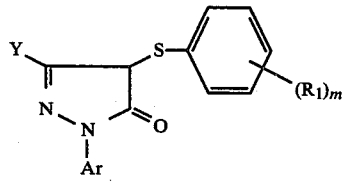

wherein Ar represents a phenyl group substituted with at least one halogen atom, an alkyl group having 1 to 22 carbon atoms, an alkoxy group having 1 to 22 carbon atoms, an alkoxycarbonyl group having 2 to 22 carbon atoms or a cyano group; $R_1$ represents a hydrogen atom, a halogen atom, an acylamino group having 1 to 22 carbon atoms, a sulfonamido group having 1 to 22 carbon atoms, a carbamoyl group having 1 to 22 carbon atoms, a sulfamoyl group having 1 to 22 carbon atoms, an alkylthio group having 1 to 22 carbon atoms, an alkoxycarbonyl group having 2 to 22 carbon atoms, a hydroxy group, an alkyl group having 1 to 22 carbon atoms, an alkoxy group having 1 to 22 carbon atoms or an aryl group having 6 to 22 carbon atoms; m represents an integer of 1 to 5; Y represents an acylamino group having 1 to 22 carbon atoms or an aniline group having 6 to 44 carbon atoms; and when m is 2 or more, $R_1$ may be the same or different.

Of the compounds represented by the general formula (Ib), more preferred compounds can be represented by the following general formula (Ic):

(Ic)

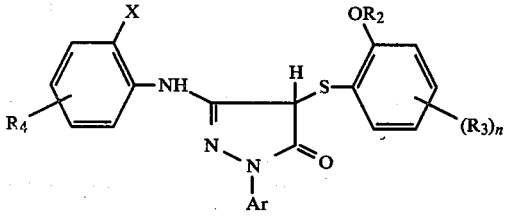

wherein Ar has the same meaning as defined in the general formula (Ib); $R_2$ represents an alkyl group having 1 to 22 carbon atoms, or an aryl group having 6 to 22 carbon atoms; X represents a halogen atom or an alkoxy group having 1 to 22 carbon atoms; $R_3$ represents a hydrogen atom, a hydroxy group, a halogen atom, an alkyl group having 1 to 36 carbon atoms, an alkoxy group having 1 to 36 carbon atoms or an aryl group having 6 to 38 carbon atoms; $R_4$ represents a hydrogen atom, a halogen atom, an alkyl group having 1 to 36 carbon atoms, an alkoxy group having 1 to 36 carbon atoms, an acylamino group having 1 to 36 carbon atoms, a sulfonamide group having 1 to 36 carbon atoms, a sulfamoyl group having 1 to 36 carbon atoms, a carbamoyl group having 1 to 36 carbon atoms, a diacylamino group having 1 to 36 carbon atoms in each acyl moiety, an alkoxycarbonyl group having 2 to 36 carbon atoms, an alkoxysulfonyl group having 1 to 36 carbon atoms, an aryloxysulfonyl group having 6 to 36 carbon atoms, an alkanesulfonyl group having 1 to 36 carbon atoms, an arylsulfonyl group having 6 to 36 carbon atoms, an alkylthio group having 1 to 36 carbon atoms, an arylthio group having 6 to 36 carbon atoms, an alkyloxycarbonylamino group having 2 to 36 carbon atoms, an alkylureido group having 1 to 36 carbon atoms, an acyl group having 1 to 36 carbon atoms, a nitro group, a carboxy group, or a trichloromethyl group; and n is an integer of from 1 to 4.

The magenta couplers of the general formula (Ic) are described in more detail below.

In the general formula (Ic), Ar is a substituted phenyl group. Substituents for the phenyl group include a halogen atom (for example, a chlorine atom, a bromine atom, a fluorine atom, etc.), an alkyl group having from 1 to 22 carbon atoms (for example, a methyl group, an ethyl group, a tetradecyl group, a tert-butyl group, etc.), an alkoxy group having from 1 to 22 carbon atoms (for example, a methoxy group, an ethoxy group, an octyloxy group, a dodecyloxy group, etc.), an alkoxycarbonyl group having from 2 to 23 carbon atoms (for example, a methoxycarbonyl group, an ethoxycarbonyl group, a tetradecyloxycarbonyl group, etc.), or a cyano group.

X in the general formula (Ic) represents a halogen atom (for example, a chlorine atom, a bromine atom, a fluorine atom, etc.) or an alkoxy group having from 1 to 22 carbon atoms (for example, a methoxy group, an octyloxy group, a dodecyloxy group etc.).

$R_4$ in the general formula (Ic) represents a hydrogen atom, a halogen atom (for example, a chlorine atom, a bromine atom, a fluorine atom, etc.), a straight chain or branched chain alkyl group (for example, a methyl group, a tert-butyl group, a tetradecyl group, etc.), an alkoxy group (for example, a methoxy group, an ethoxy group, a 2-ethylhexyloxy group, a tetradecyloxy group, etc.), an arylamino group (for example, an acetamido group, a benzamido group, a butanamido group, a tetradecanamido group, an α-(2,4,-di-tert-amylphenoxy)-acetamido group, an α-(2,4-di-tert-amylphenoxy)-butyramido group, an α-(3-pentadecylphenoxy)hexanamido group, an α-(4-hydroxy-3-tert-butylphenoxy)-tetradecanamido group, a 2-oxopyrrolidin-1-yl group, a 2-oxo-5-tetradecylpyrrolidin-1-yl group, an N-methyltetradecanamido group, etc.), a sulfonamido group (for example, a methanesulfonamido group, a benzenesulfonamido group, a p-toluenesulfonamido group, an octanesulfonamido group, a p-dodecylbenzenesulfonamido group, an N-methyltetradecanesulfonamido group, etc.), a sulfamoyl group (for example, an N-methylsulfamoyl group, an N-hexadecylsulfamoyl group, an N-[3-(dodecyloxy)propyl]sulfamoyl group, an N-[4-(2,4-di-tert-amylphenoxy)butyl]sulfamoyl group, an N-methyl-N-tetradecylsulfamoyl group, etc.), a carbamoyl group (for example, an N-methylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (for example, an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, an octyloxysulfonyl group, a tetradecyloxysulfonyl group, etc.), an aryloxysulfonyl group (for example, a phenoxysulfonyl group, a 2,4-di-tert-amylphenoxysulfonyl group, etc.), an alkanesulfonyl group (for example, a methanesulfonyl group, an octanesulfonyl group, a 2-ethylhexanesulfonyl group, a hexadecanesulfonyl group, etc.), an arylsulfonyl group (for example, a benzenesulfonyl group, a 4-nonylbenzenesulfonyl group, etc.), an alkylthio group (for example, an ethylthio group, a hexylthio group, a benzylthio group, a tetradecylthio group, a 2-(2,4-di-tert-amylphenoxy)ethylthio group, etc.), an arylthio group (for example, a phenylthio group, a p-tolylthio group, etc.), an alkyloxycarbonylamino group (for example, an ethyloxycarbonylamino group, a benzyloxycarbonylamino group, a hexadecyloxycarbonylamino group, etc.), an alkylureido group (for example, an N-methylureido group, an N,N-dimethylureido group, an N-methyl-N-dodecylureido group, an N-hexadecylureido group, an N,N-dioctadecylureido group, etc.), an acyl group (for example, an acetyl group, a benzoyl group, an octadecanoyl group, a p-dodecanamidobenzoyl group, etc.), a nitro group, a carboxy group or a trichloromethyl group. In the above-described substituents, the alkyl moieties thereof preferably have from 1 to 36 carbon atoms, and the aryl moieties thereof preferably have from 6 to 38 carbon atoms.

$R_2$ in the general formula (Ic) represents an alkyl group having from 1 to 22 carbon atoms (for example, a methyl group, a propyl group, a butyl group, a 2-methoxyethyl group, a methoxymethyl group, a hexyl group, a 2-ethylhexyl group, a dodecyl group, a hexadecyl group, a 2-(2,4-di-tert-amylphenoxy)ethyl group, a 2-dodecyloxyethyl group, etc.) or an aryl group (for example, a phenyl group, an $\alpha$- or $\beta$-naphthyl group, a 4-tolyl group, etc.).

$R_3$ in the general formula (Ic) represents a hydrogen atom, a hydroxy group, or a halogen atom, an alkyl group, an alkoxy group, or an aryl group, each as defined for $R_4$ above.

Of the couplers represented by the general formula (Ic) those in which the total number of carbon atoms included in the groups represented by $R_2$ and $R_3$ is not less than 6 are particularly preferred for achieving the objects of the present invention.

Specific examples of the typical couplers according to the present invention are set forth below, but the present invention is not to be construed as being limited to these compounds.

I-1

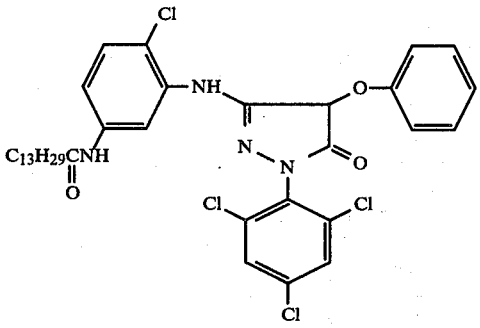

I-2

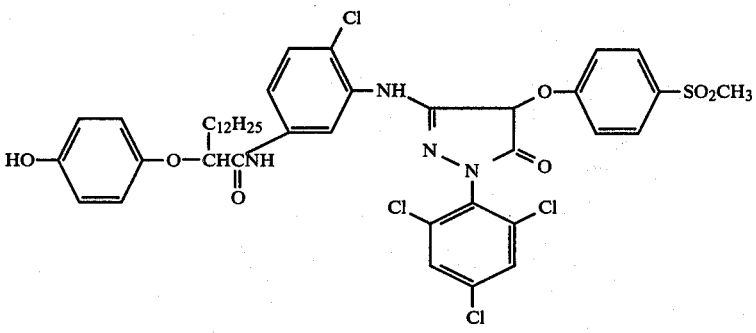

I-3

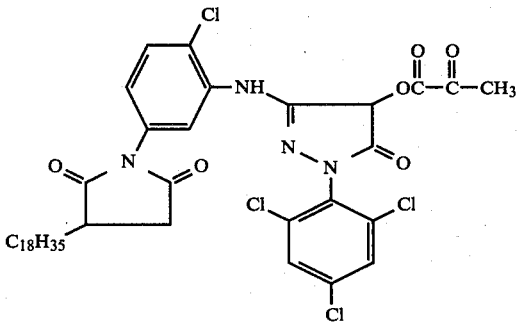

I-4

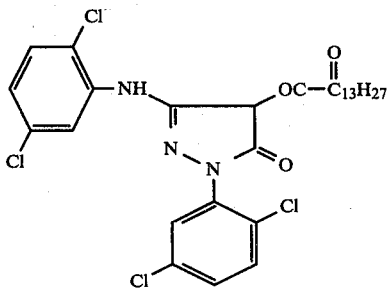

-continued
I-5
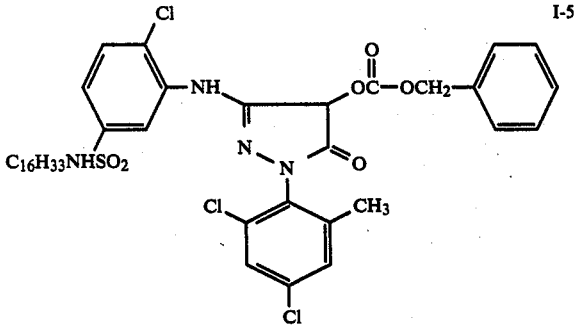
I-6
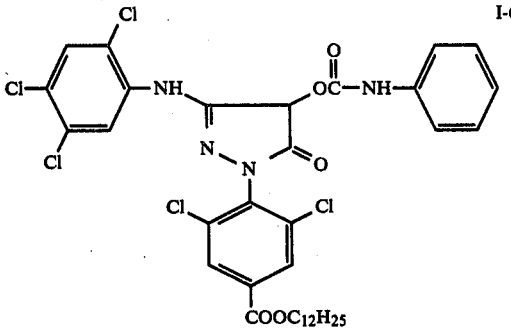
I-7
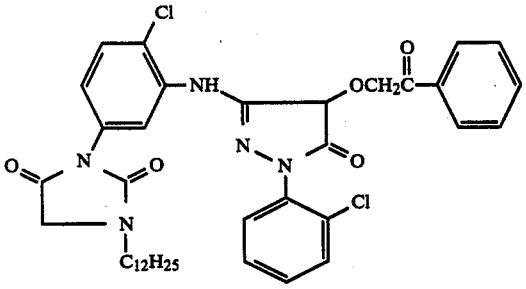
I-8
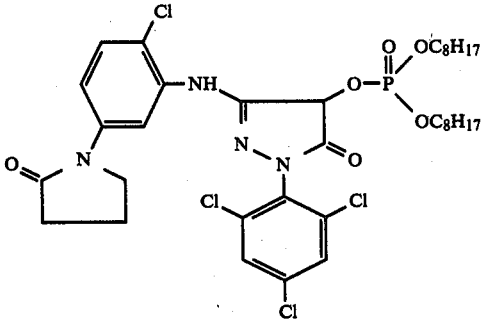
I-9
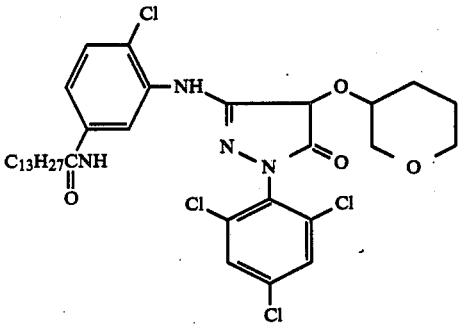
I-10
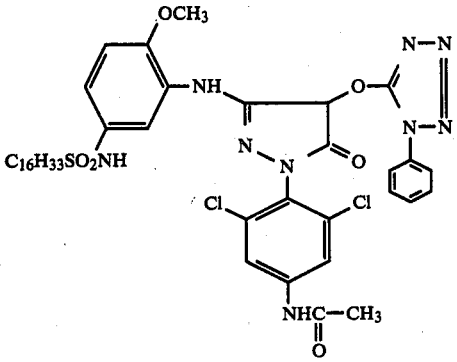
I-11
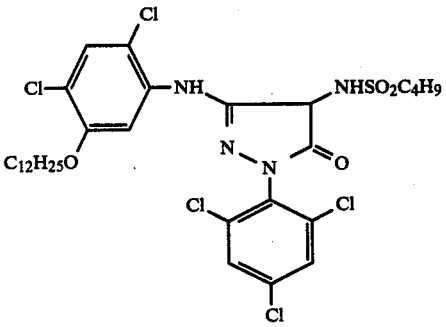
I-12
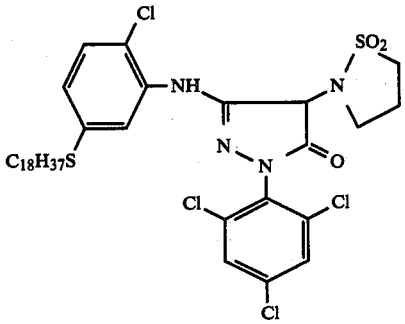
I-13
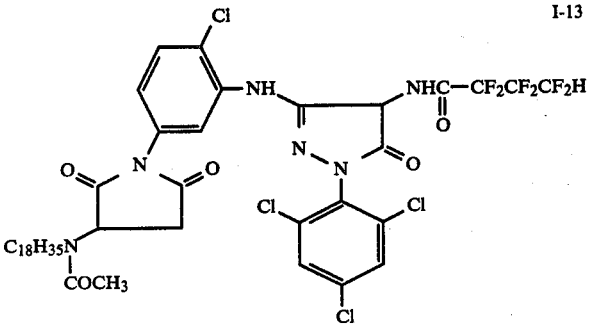
I-14
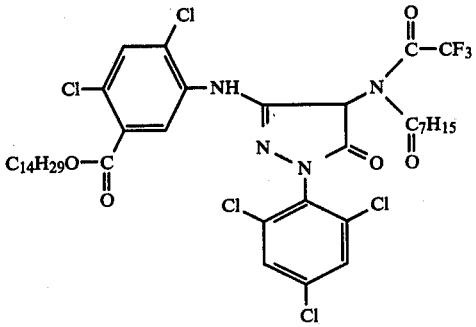

-continued
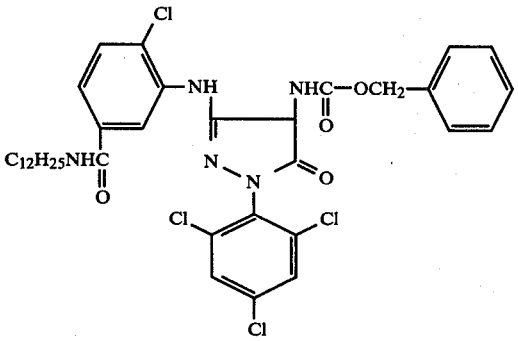
I-15
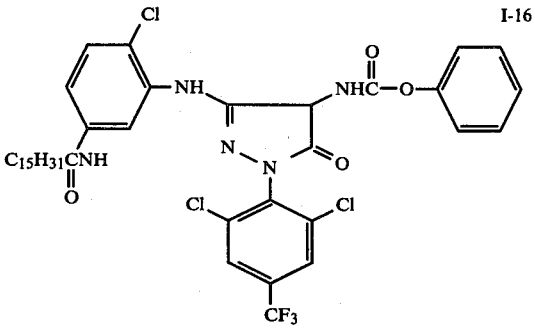
I-16
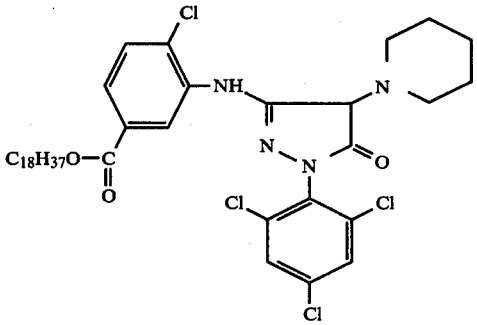
I-17
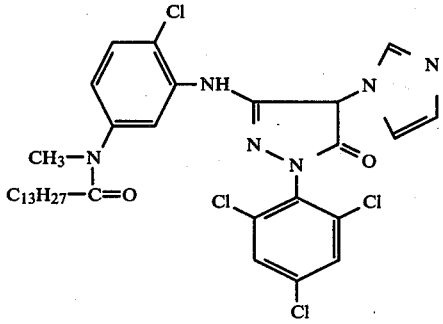
I-18
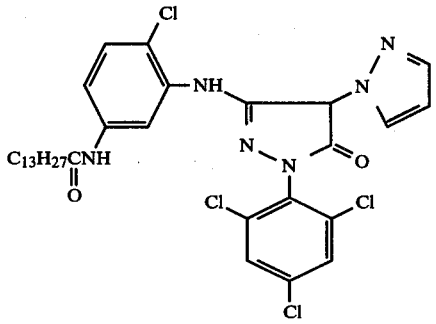
I-19
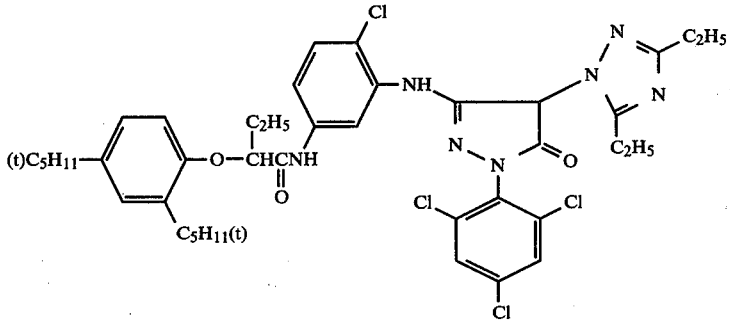
I-20

-continued
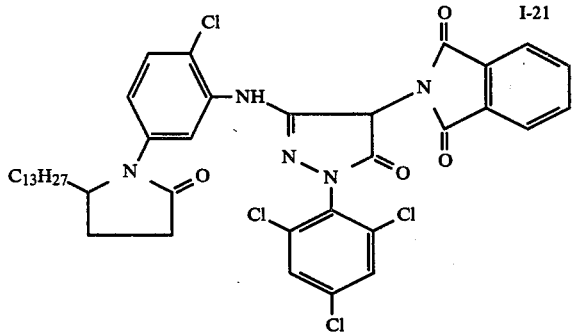
I-21
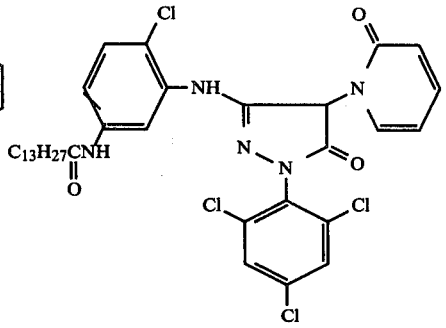
I-22
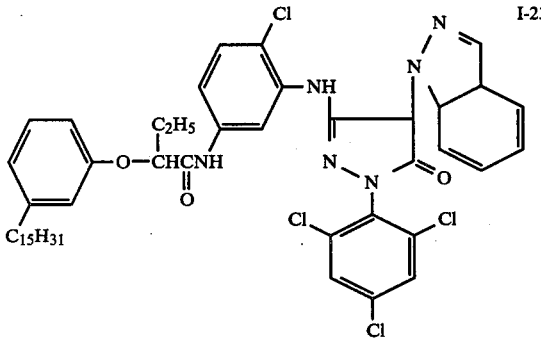
I-23
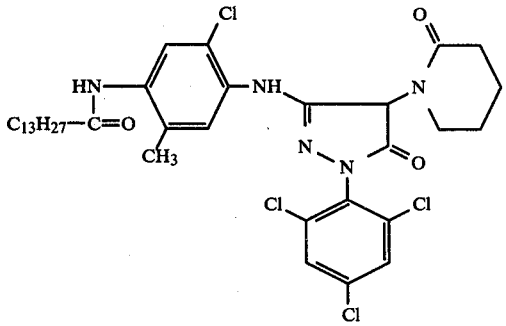
I-24
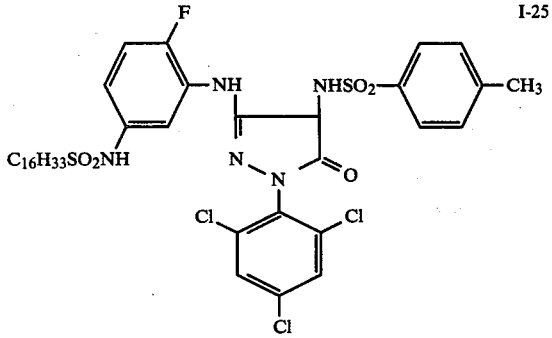
I-25
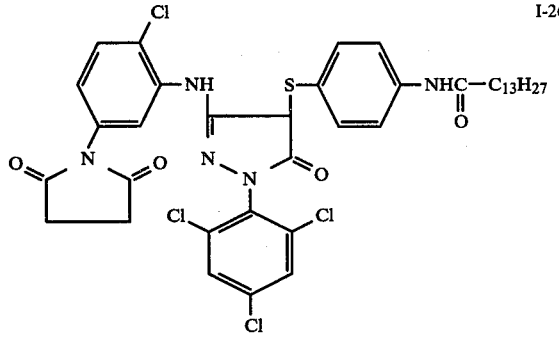
I-26
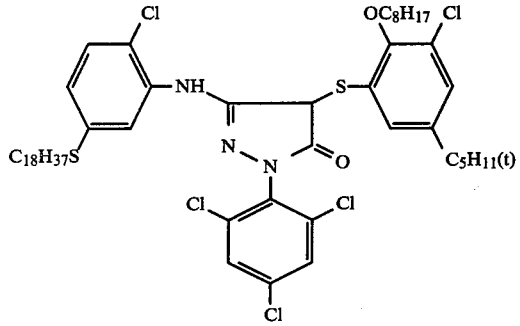
I-27
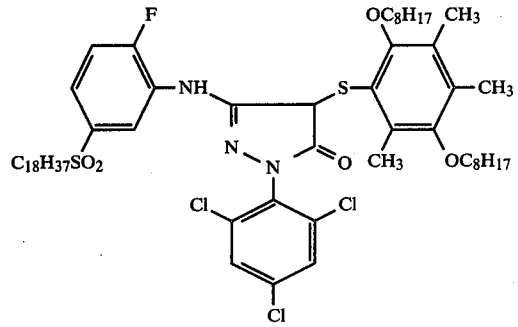
I-28

-continued
I-29
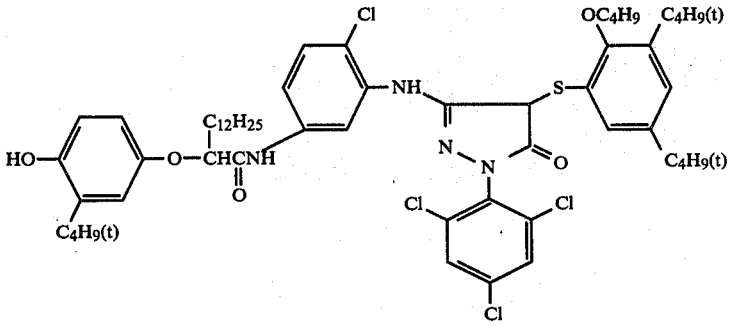
I-30
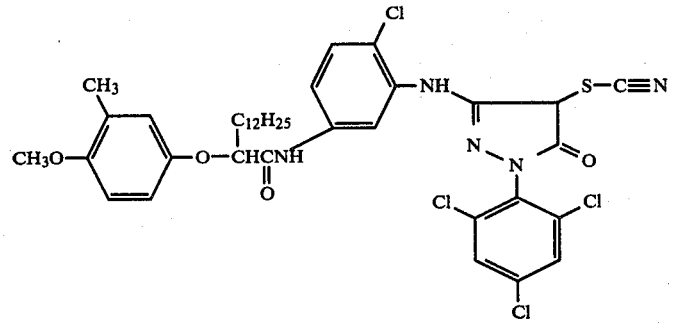
I-31
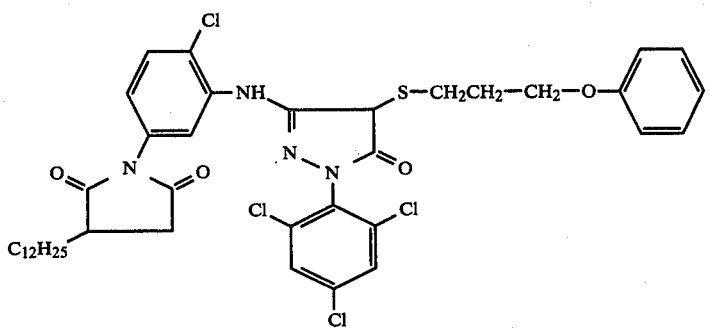
I-32
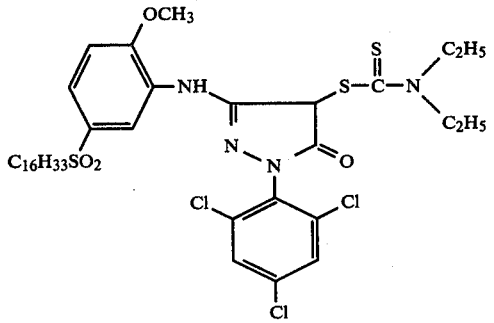
I-33
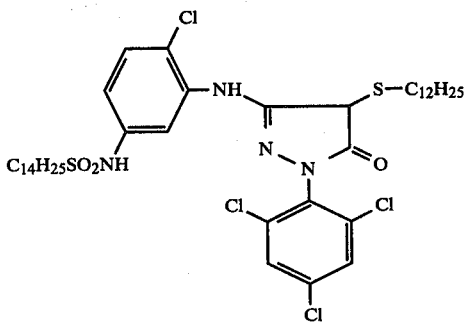
I-34
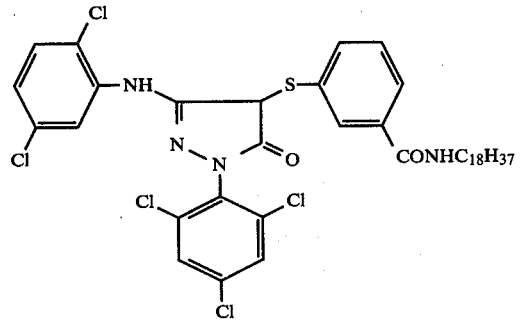
I-35
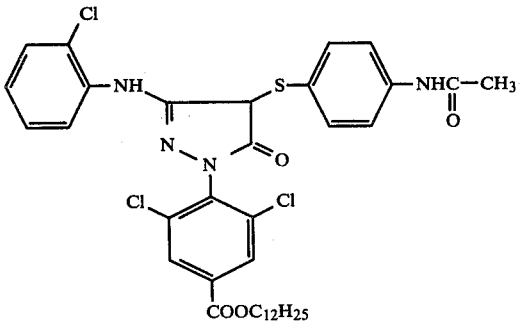

-continued
I-36
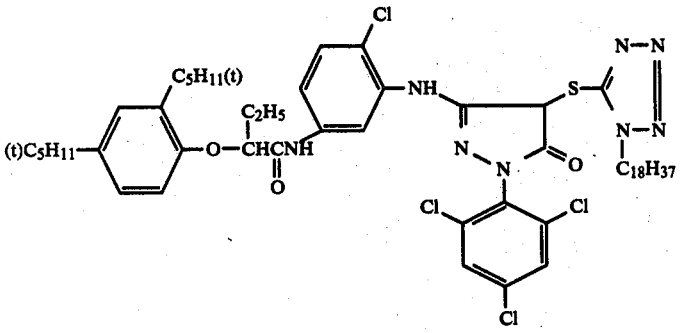
I-37
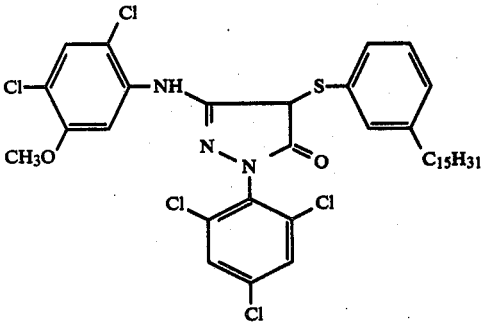
I-38
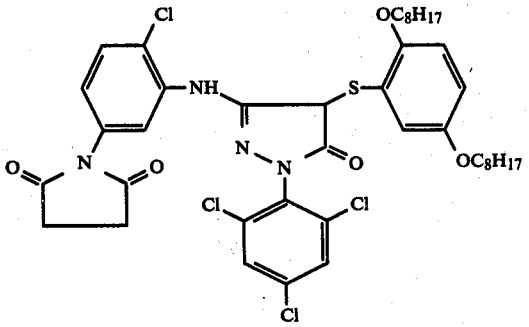
I-39
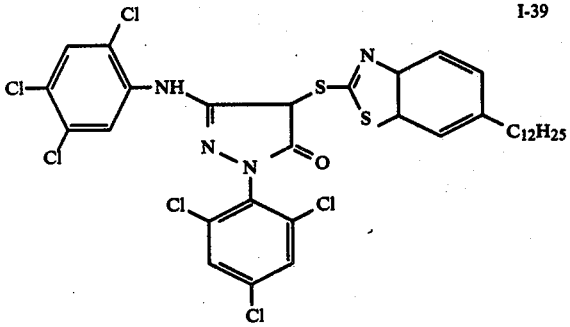
I-40
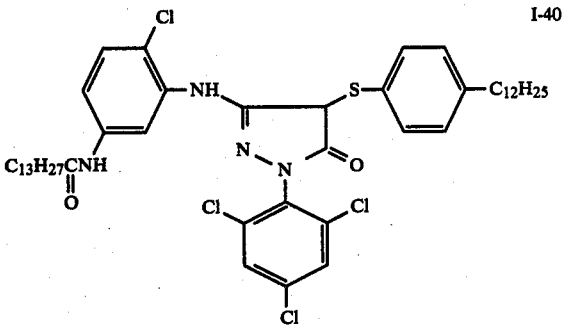
I-41
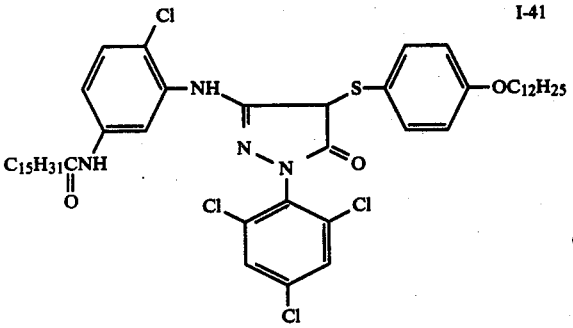
I-42
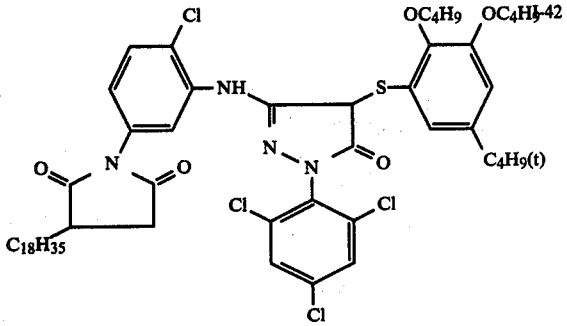
I-43
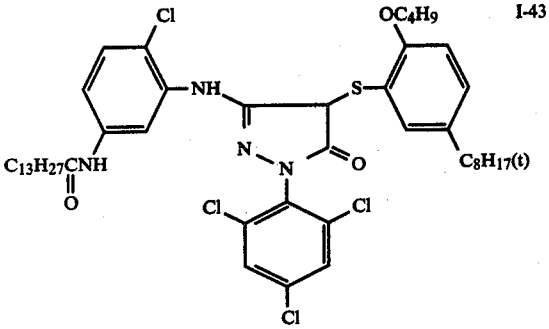
I-44
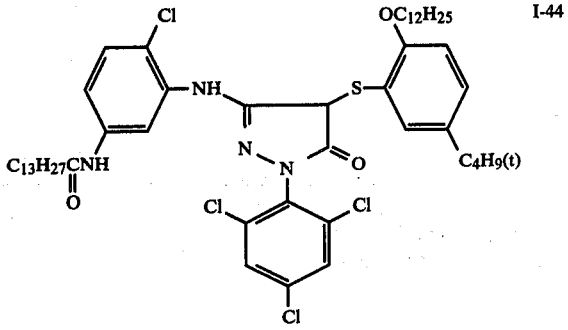

-continued
I-45
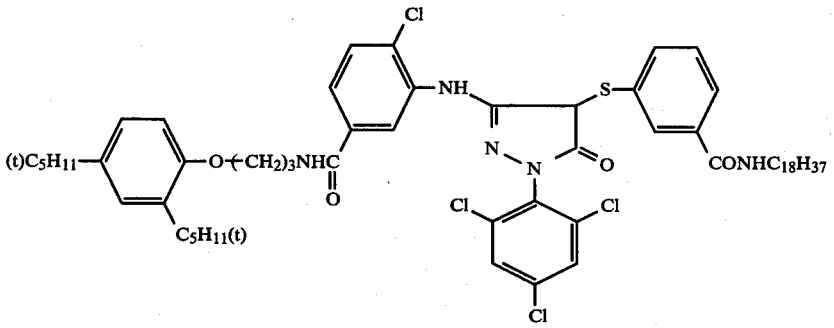
I-46
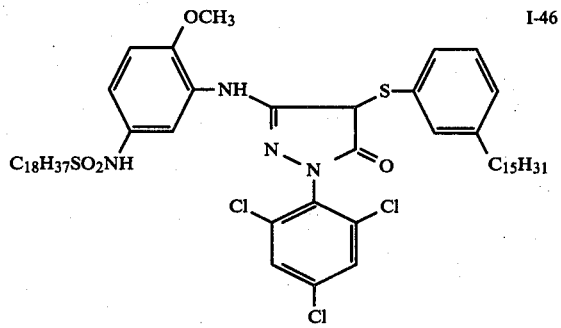
I-47
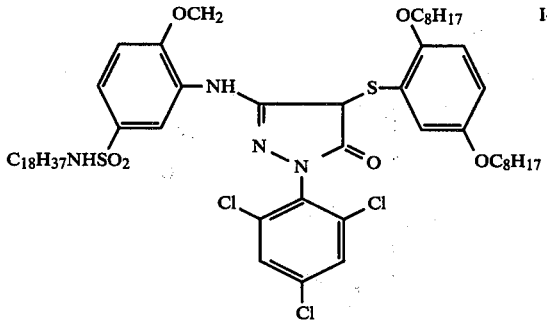
I-48
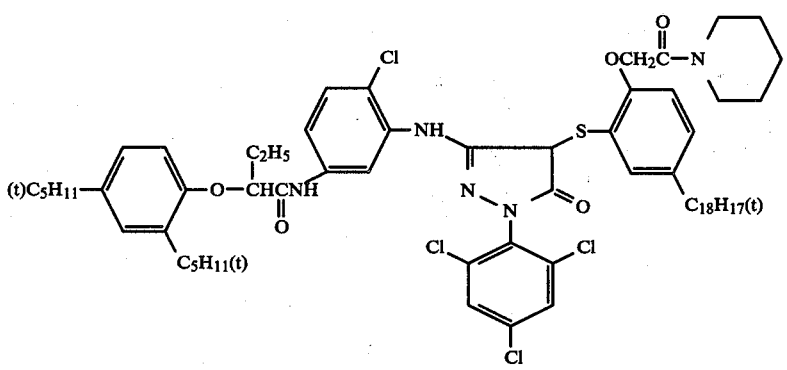
I-49
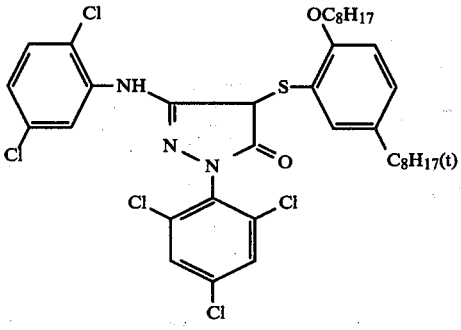
II-1
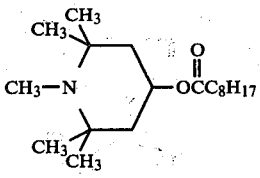
Specific examples of the typical piperidine compounds according to the present invention represented by general formula (II) are set forth below, but the present invention is not to be construed as being limited to these compounds.

-continued

II-2

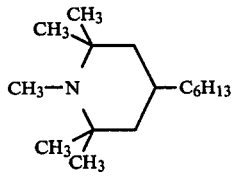

II-3

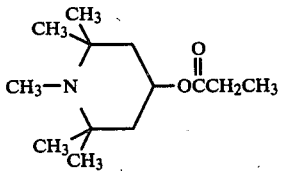

II-4

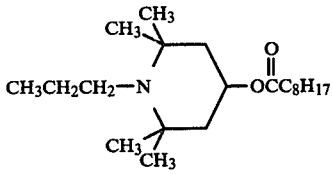

II-5

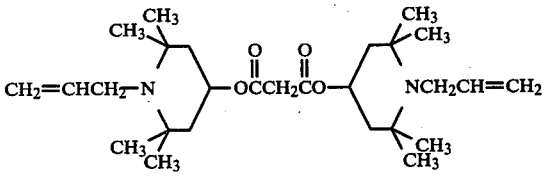

II-6

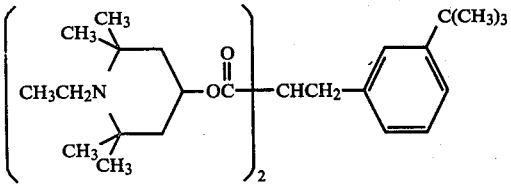

II-7

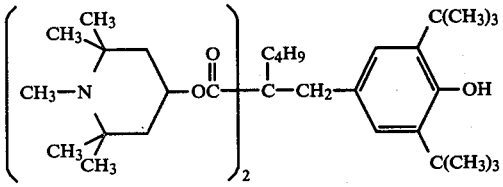

II-8

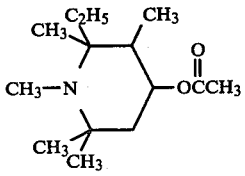

II-9

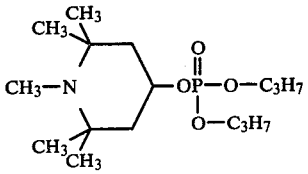

-continued

II-10

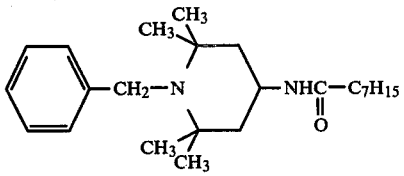

II-11

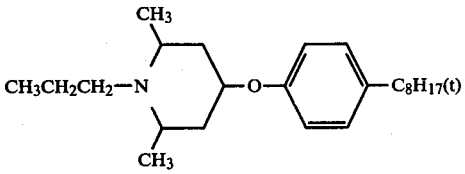

II-12

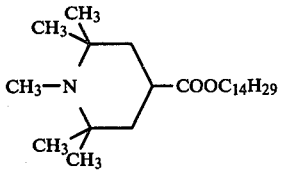

II-13

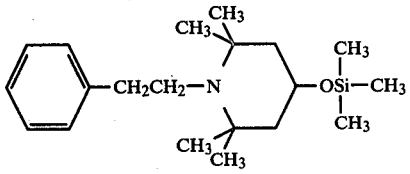

II-14

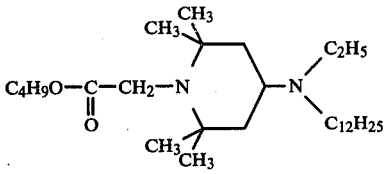

Compounds which are similar to compounds represented by the general formula (II) are generally known as degradation preventing agents for polymers. Also, some compounds are known to improve durability of color images in color photographic materials as described in Japanese Patent Application (OPI) No. 65953/80. However, these compounds are used for the purpose of improving the durability of yellow color forming images or cyan color forming images against light, temperature, or humidity and the effect owing to the combination of magenta couplers according to the present invention is not referred to at all in this Japanese Patent Application. The effect of preventing stain due to development processing using 4-arylthio-5-pyrazolone 2-equivalent magenta couplers according to the present invention which is completely different from that of the prior arts cannot be expected in any way from these known techniques.

The compound represented by the general formula (Ia), (Ib) or (Ic) and the compound represented by the general formula (II) can be added to different layers of the photographic light-sensitive material. However, it is desirable that they are added in the same layer. Particularly, they are preferably used as a dispersion which is prepared by dispersing them at the same time.

The relative amount of the compound represented by the general formula (II) to the amount of the compound represented by the general formula (Ia), (Ib) or (Ic) is preferably from 5 mol% to 500 mol% and more preferably from 20 mol% to 100 mol%.

The compound represented by the general formula (Ia), (Ib) or (Ic) and the compound represented by the general formula (II) are preferably used by dissolving them in a solvent having a high boiling point and then dispersing the solution. Any known solvents can be used as the above described solvent having a high boiling point, particularly an organic solvent having a boiling point of not less than 180° C. For example, a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyl laurylamide, etc.), a fatty acid ester (e.g., dibutoxyethyl succinate, dioctyl azelate, etc.), a trimesic acid ester (e.g., tributyl trimesate, etc.), etc., as described in U.S. Pat. No. 2,322,027 are preferably used. Also, those described in U.S. Pat. Nos. 2,322,027, 2,533,514 and 2,835,579, Japanese Patent Publication No. 23233/71, U.S. Pat. No. 3,287,134, British Pat. No. 958,441, Japanese Patent Application (OPI) No. 1031/72, British Pat. No. 1,222,753, U.S. Pat. No. 3,936,303, Japanese Patent Application (OPI) Nos. 26037/76 and 82078/77, U.S. Pat. Nos. 2,353,262, 2,852,383, 3,554,755, 3,676,137, 3,676,142, 3,700,454, 3,748,141 and 3,837,863, West German Patent Application (OLS) No. 2,538,889, Japanese Patent Application (OPI) Nos. 27921/76, 27922/76, 26035/76, 26036/76 and 62632/70, Japanese Patent Publication No. 29461/74, U.S. Pat. Nos. 3,936,303 and 3,748,141, Japanese Patent Application (OPI) No. 1521/78, etc., are preferred. In particular, an alkyl phosphate (e.g., diphenyl phosphate, triphenyl phosphate, tricresyl phosphate, dioctyl butyl phosphate, etc.) is preferred.

Oil-soluble couplers are preferably used in the present invention.

Examples of useful magenta couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, Japanese Patent Application No. 110943/80, etc., may be used together with the 2-equivalent magenta coupler according to the present invention.

Examples of yellow couplers include a benzoylacetanilide type compound and a pivaloylacetanilide type compound which have been found to be advantageously used in the practice of the present invention. Specific examples of the yellow couplers which can be used include those described in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77, etc.

Useful cyan couplers include a phenol compound and a naphthol compound. Specific examples thereof include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 69624/77 and 90932/77, etc.

Useful colored couplers nclude those described in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and West German Patent Application (OLS) No. 2,418,959, etc.

Useful DIR couplers include those described in U.S. Pat. Nos. 3,227,554, 3,617,291, 3,701,683, 3,790,384 and 3,632,345, West German Patent Application (OLS) Nos. 2,414,006, 2,454,301 and 2,454,329, British Pat. No. 953,454, Japanese Patent Application (OPI) Nos. 69624/77 and 122335/74 and Japanese Patent Publication No. 16141/76.

In addition to a DIR coupler, the photographic light-sensitive material may contain a compound which releases a development inhibitor during development. For example, those described in U.S. Pat. Nos. 3,297,445, 3,297,445 and 3,379,529, West German Patent Application (OLS) No. 2,417,914 and Japanese Patent Application (OPI) Nos. 15271/77 and 9116/78 can be used.

Two or more of the above described couplers may be contained in the same layer. Two or more layers may contain the same compound.

These couplers are generally added in an amount of from $2\times10^{-3}$ mol to $5\times10^{-1}$ mol, and preferably from $1\times10^{-2}$ mol to $5\times10^{-1}$ mol per mol of silver in the emulsion layer.

A ratio of oil/coupler is preferably from 0.0 to 2.0.

In order to incorporate the above described couplers into a hydrophilic colloid layer, the method using the above described organic solvent having a high boiling point as described in U.S. Pat. No. 2,322,027 can be employed, or they may be dissolved in an organic solvent having a boiling point of from about 30° to 150° C., for example, a lower alkyl acetate (e.g., ethyl acetate, butyl acetate, etc.), ethyl propionate, sec-butyl alcohol, methyl isobutyl ketone, β-ethoxyethyl acetate, methyl cellosolve acetate, etc., and then the solution is dispersed in a hydrophilic colloid. The above described organic solvents having a high boiling point and the above described organic solvent having a low boiling point may be used as mixtures, if desired.

Furthermore, the dispersing method using a polymeric material as described in Japanese Patent Publication No. 39853/76 and U.S. Pat. No. 4,304,769 can also be used.

When a coupler having an acid group, such as a carboxylic acid group, a sulfonic acid group, etc., is used, it can be incorporated in a hydrophilic colloid as an alkaline aqueous solution thereof.

A subbing layer for the photographic light-sensitive material of the present invention is a hydrophilic colloid layer comprising a hydrophilic polymer such as gelatin (a binder or a protective colloid for a photographic emulsion described hereinafter can also be used) and is usually provided by coating on a support. By the provision of the subbing layer, in general, adhesion to the photographic emulsion layer can be improved and halation may be prevented.

The color photographic light-sensitive material of the present invention can be applied to any known color photographic light-sensitive material as far as they are subjected to color development processing, for example, color papers, color negative films, color reversal films, etc. It is particularly preferred to apply to photographic light-sensitive materials for printing (for example, color papers, etc.).

The silver halide photographic emulsion used in the present invention can be prepared by using processes described in P. Glafkides, *Chimie et Physique Photographique* (published by Paul Montel Co., 1967); G. F. Duffin, *Photographic Emulsion Chemistry (published by The Focal Press,* 1966); V. L. Zelikman et al., *Making and Coating Photographic Emulsion* (published by The Focal Press, 1964); etc. Any of an acid process, neutral process or ammonia process may be used. Further, a single jet process, a double jet process, or a combination thereof can be used for reacting a soluble silver salt with a soluble halide.

A process for forming particles in the presence of excess silver ion (the so-called reverse mixing process) can be used, too. One useful double jet process involves keeping the liquid phase for forming silver halide at a definite pAg, namely, the so-called controlled double jet process. According to this process, a silver halide emulsion having a regular crystal form and nearly uniform particle size can be obtained.

Two or more silver halide emulsions prepared separately may also be blended.

In the photographic emulsion layer of the photograpic light-sensitive material of the present invention, any of silver bromide, silver iodobromide, silver iodochlorobromide, silver chlorobromide and silver chloride can be used as the silver halide.

In the step of formation of silver halide particles or the step of physical ripening, a cadmium salt, a zinc salt, a lead salt, a thallium salt, an iridium salt or a complex salt thereof, a rhodium salt or a complex salt thereof, an iron salt or a complex salt thereof, etc., may be added thereto.

The photographic emulsion used in the present nvention may be spectrally sensitized by methine dyes or others. Examples of dyes used include a cyanine dye, a merocyanine dye, a complex cyanine dye, a complex merocyanine dye, a holopolar cyanine dye, a hemicyanine dye, a styryl dye and a hemioxonol dye. Particularly useful dyes can be selected from the group consisting of a cyanine dye, a merocyanine dye, and a complex merocyanine dye. In these dyes, it is possible to utilize any basic heterocyclic nucleus conventionally utilized for a cyanine dye. Namely, it is possible to utilize a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; the above described nuclei to which an alicyclic hydrocarbon ring is fused; and the above described nuclei to which an aromatic hydrocarbon ring is fused, namely, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may have substituents on the carbon atoms thereof.

In the merocyanine dye and the complex merocyanine dye, it is possible to utilize, as a nucleus having a ketomethylene structure, a 5- to 6-member heterocyclic nucleus such as a pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, etc.

Examples of useful sensitizing dyes include those described in German Pat. No. 929,080, U.S. Pat. Nos. 2,231,658, 2,493,748, 2,503,776, 2,519,001, 2,912,329, 3,656,959, 3,672,897, 3,694,217, 4,025,349, and 4,046,572, British Pat. No. 1,242,588, and Japanese Patent Publication Nos. 14030/69 and 24844/77.

These sensitizing dyes may be used alone, but a combination of them may be used, too. The combination of the sensitizing dyes is frequently used for the purpose of supersensitization. Examples thereof have been described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78 and Japanese Patent Application (OPI) Nos. 110618/77 and 109925/77.

The emulsion may contain a dye which does not have a spectral sensitization function, or a substance showing supersensitization which does not substantially absorb visible rays together with the sensitizing dye. For example, the emulsion may contain an aminostilbene compound substituted with a nitrogen-containing heterocyclic group (for example, those described in U.S. Pat. Nos. 2,933,390 and 3,635,721), an aromatic acidformaldehyde condensed product (for example, those described in U.S. Pat. No. 3,743,510), a cadmium salt and an azaindene compound. Combinations as described in U.S. Pat. Nos. 3,615,613, 3,615,641, 3,617,295 and 3,635,721 are particularly useful.

The binder or protective colloid for the photographic emulsion is preferably gelatin, but other hydrophilic colloids may be used, too.

For example, it is possible to use a protein such as a gelatin derivatives, a graft polymer of gelatin with other polymers, albumin, or casein; saccharides, including a cellulose compound such as hydroxyethyl cellulose, carboxymethyl cellulose, cellulose sulfate, etc., sodium alginate, a starch derivative, etc.; and synthetic hydrophilic polymeric substances such as a homopolymer or a copolymer such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

The gelatin may be not only lime-processed gelatin, but also acid-processed gelatin, and enzyme-processed gelatin, as described in *Bull. Soc. Sci. Phot. Japan,* No. 16, page 30 (1966). Further, a hydrolyzed product and an enzymatic product of gelatin can be used. Gelatin derivatives may be obtained by reacting gelatin with various compounds such as an acid halide, an acid anhydride, an isocyanate, a bromoacetic acid, an alkanesultone, a vinylsulfonamide, a maleinimide, a polyalkylene oxide, an epoxy compound, etc. Examples thereof have been described in U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc.

The above described gelatin graft polymer may be produced by grafting a homopolymer or a copolymer of a vinyl monomer such as acrylic acid, methacrylic acid and a derivative thereof such as an ester or an amide, acrylonitrile, styrene, etc., on gelatin. It is particularly preferred to use a graft polymer of gelatin and a polymer having some degree of compatibility with gelatin, such as a polymer of acrylic acid, methacrylic acid, acrylamide, methacrylamide or hydroxyalkyl methacrylate, etc. Examples thereof have been described in U.S. Pat. Nos. 2,763,625, 2,831,767, 2,956,884, etc.

Examples of typical synthetic hydrophilic polymeric substances include those described in West German Patent Application (OLS) No. 2,312,708, U.S. Pat. No. 3,620,751 and 3,879,205, and Japanese Patent Publication No. 7561/68.

The present invention can be applied to a multilayer multicolor photographic light-sensitive material comprising at least two layers having different spectral sensitivities on a support. The multilayer color photographic light-sensitive material generally has at least a red-sensitive emulsion layer, a green-sensitive emulsion layer, and a blue-sensitive emulsion layer on the support. The order of these layers may be suitably varied as occasion demands. Generally, for natural color reproduction, the red-sensitive emulsion layer contains a cyan forming coupler, the green-sensitive emulsion layer contains a magenta forming coupler, and the blue-sensitive emulsion layer contains a yellow forming coupler. However, if desired, other combinations may be utilized.

In the light-sensitive material produced according to the prsent invention, the hydrophilic colloid layer may contain a water-soluble dye as a filter dye or for other purposes such as prevention of irradiation. Examples of such dyes include an oxonol dye, a hemioxonol dye, a styryl dye, a merocyanine dye, a cyanine dye, and an azo dye. Among them, an oxonol dye, a hemioxonol dye and a merocyanine dye are particularly useful. Specific examples of such dyes capable of being used include those described in British Pat. Nos. 584,609 and 1,177,429, Japanese Patent Application (OPI) Nos. 85130/73, 99620/74, 114420/74 and 108115/77, and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In carrying out the present invention, known agents for preventing color fading may be used. Further, such dye image stabilizers in the present invention may be used alone, or two or more of them may be used together. Examples of the known agents for preventing color fading include a hydroquinone derivative as described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc., a gallic acid derivative as described in U.S. Pat. Nos. 3,457,079, 3,069,262, etc., p-alkoxyphenol as described in U.S. Pat. Nos. 2,735,765 and 3,698,909, Japanese Patent Publication Nos. 20977/74 and 6623/77, a p-oxyphenol derivative as described in U.S. Pat. Nos. 3,432,300, 3,573,050, 3,574,627 and 3,764,337 and Japanese Patent Application (OPI) Nos. 35633/77, 147434/77 and 152225/77, and a bisphenol as described in U.S. Pat. No. 3,700,455.

The photographic light-sensitive material prepared according to the present invention can also contain, as a color fog preventing agent, a hydroquinone derivative, an aminophenol derivative, a gallic acid derivative, an ascorbic acid derivative, or the like. Specific examples of these agents are described in U.S. Pat. Nos. 2,360,290, 2,336,327, 2,403,721, 2,418,613, 2,675,314; 2,701,197, 2,704,713, 2,728,659, 2,732,300 and 2,735,765, Japanese Patent Application (OPI) Nos. 92988/75, 92989/75, 93928/75, 110337/75 and 146235/77, Japanese Patent Publication No. 23813/75, and so forth.

In the light-sensitive material produced according to the present invention, it is preferred that the hydrophilic colloid layer contain an ultraviolet ray absorbing agent. For example, it is possible to use a benzotriazole compound substituted with an aryl group (for example, those described in U.S. Pat. No. 3,533,794), a 4-thiazolidone compound (for example, those described in U.S. Pat. Nos. 3,314,794 and 3,352,681), a benzophenone compound (for example, those described in Japanese Patent Application (OPI) No. 2784/71, a cinnamic acid ester compound (for example, those described in U.S. Pat. Nos. 3,705,805 and 3,707,375), a butadiene compound (for example, those described in U.S. Pat. No. 4,045,229), and a benzoxazole compound (for example, those described in U.S. Pat. No. 3,700,455). Further, it is possible to use those described in U.S. Pat. No. 3,499,762 and Japanese Patent Application (OPI) No. 48535/79. A coupler having an ultraviolet ray absorbing property (for example, an $\alpha$-naphthol type cyan dye forming coupler) and a polymer having an ultraviolet ray absorbing property may be used, too. These ultraviolet ray absorbing agents may be mordanted on a specified layer.

In the light-sensitive material produced according to the present invention, the photographic emulsion layer and other hydrophilic colloid layers may contain a whitening agent such as a stilbene, triazine, oxazole, or coumarin compound. They may be water-soluble. Further, a water-insoluble whitening agent may be used in a dispersed state. Specific examples of the fluorescent whitening agents include those described in U.S. Pat. Nos. 2,632,701, 3,269,840 and 3,359,102, British Pat. Nos. 852,075 and 1,319,763, etc.

In the photographic light-sensitive material of the present invention, the photographic emulsion layer and other hydrophilic layers can be coated on a support or other layers using various known coating methods. A dip coating method, a roller coating method, a curtain coating method, an extrusion coating method, etc., can be employed for coating. The methods as described in U.S. Pat. Nos. 2,681,294, 2,761,791 and 3,526,528 are advantageously employed.

The photographic processing of the light-sensitive material of the present invention can be carried out by any known process. Known processing solutions can be used. The processing temperature is selected, generally, from 18° C. to 50° C., but a temperature of lower than 18° C. or higher than 50° C. may be used. Any color development processings as far as they provide dye images can be employed depending on the purpose.

The color developing solution is generally composed of an alkaline aqueous solution containing a color developing agent. The color developing agent may be a known primary aromatic amine developing agent. Examples of these agents include a phenylenediamine (for example, 4-amino-N,N-diethylaniline, 3-methyl-4-amino-N,N-diethylanilne, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.).

In addition, those described in L. F. A. Mason, *Photographic Processing Chemistry* (Focal Press, 1966) pages 226–229, U.S. Pat. Nos. 2,193,015 and 2,592,364, and Japanese Patent Application (OPI) No. 64933/73 may be used.

The color developing solution may contain a pH buffer agent such as a sulfite, a carbonate, a borate or a phosphate of an alkali metal, and a development restrainer or an antifogging agent such as a bromide, an iodide, an organic antifogging agent, etc. If necessary, it may contain a water softener, a preservative such as hydroxylamine, an organic solvent such as benzyl alcohol or diethylene glycol, a development accelerator such as polyethylene glycol, a quaternary ammonium salt or an amine, a dye forming coupler, a competitive coupler, a fogging agent such as sodium borohydride, a thickener, a polycarboxylic acid type chelating agent as described in U.S. Pat. No. 4,083,723, and an antioxidant as described in West German Patent Application (OLS) No. 2,622,950, etc.

After carrying out the color development, the photographic emulsion layers are generally subjected to bleaching. The bleaching may be carried out simultaneously with fixing or may be carried out separately. The bleaching agent may be a compound of a polyvalent metal such as iron (III), cobalt (III), chromium (VI) or copper (II), etc., a peracid, a quinone or a nitroso compound. For example, it is possible to use a ferricyanide, a bichromate, and an organic complex salt of iron (III) or cobalt (III), for example, a complex salt of an aminopolycarboxylic acid such as ethylenediaminetetraacetic acid, nitrilotriacetic acid or 1,3-diamino-2-propanol tetraacetic acid, etc., or an organic acid such as citric acid, tartaric acid, malic acid, etc.; a persulfate; a permanganate; nitrosophenol; etc. Among them, potassium ferricyanide, (ethylenediaminetetraacetato)iron (III) sodium complex and (ethylenediaminetetraacetato)iron (III) ammonium complex are particularly useful. (Ethylenediaminetetraacetato)iron (III) complexes are useful for both a bleaching solution and a mono-bath bleach-fix solution.

To the bleaching solution or the bleach-fix solution, it is possible to add a bleaching accelerator as described in U.S. Pat. Nos. 3,042,520 and 3,241,966, and Japanese Patent Publication Nos. 8506/70 and 8836/70, a thiol compound as described in Japanese Patent Application (OPI) No. 65732/78, and various other additives.

The photographic light-sensitive materials according to the present invention are preferably processed with the developing solution replenished or controlled by the methods as described in Japanese Patent Application (OPI) Nos. 84636/76, 119934/77, 46732/78, 9626/79, 19741/79, 37731/79, 1048/81, 1049/81 and 27147/81, etc.

The bleach-fix solution used for processing the photographic light-sensitive material according to the present invention is preferably that which is regenerated by the processes as described in Japanese Patent Application (OPI) Nos. 781/71, 49437/73, 18191/73, 145231/75, 18541/76, 19535/76 and 144620/76 and Japanese Patent Publication No. 23178/76, etc.

In order to accelerate color development, a color developing agent or a derivative thereof may be previously incorporated into the photographic light-sensitive material. For example, it may be incorporated as a metal salt or a Schiff's base. Specific examples of these compounds which can be used are described in U.S. Pat. Nos. 3,719,492 and 3,342,559, *Research Disclosure,* No. 15159 (1976). Further, a developing agent such as a hydroquinone, a 3-pyrazolidone derivative or an aminophenol derivative, etc., may be incorporated into the photographic light-sensitive material. The compounds as described in British Pat. Nos. 767,404, 1,032,925 and 2,073,734A, Japanese Patent Application (OPI) Nos. 64339/81, 89739/81 and 30338/81 can be used.

The present invention is illustrated in greater detail by reference to the following examples, but the present invention is not to be construed as being limited thereto.

EXAMPLE 1

On a polyethylene terephthalate film support was coated a coating solution comprising silver chlorobromide (silver bromide: 90 mol%; coating amount of silver: 720 mg/m$^2$), gelatin (2,000 mg/m$^2$) and a dispersion of a 4-equivalent magenta coupler, i.e., 1-(2,4,6-trichlorophenyl)-3-(2-chloro-5-tetradecanamido)anilino-2-pyrazolin-5-one (600 mg/m$^2$) and 2,5-di-tert-octyl hydroquinone (80 mg/m$^2$) together with a coupler solvent, i.e., o-cresyl phosphate (800 mg/m$^2$). On this emulsion layer was coated a gelatin protective layer (1,000 mg/m$^2$) to prepare Sample 1.

Using the 2-equivalent magenta couplers according to the present invention, i.e., Couplers I-19, I-20, I-36, I-44 and I-46 in place of the 4-equivalent magenta coupler and reducing the coating amount of silver halide to one half of that in Sample 1, Samples 2, 4, 6, 8 and 10 were prepared, respectively. Further, the piperidine compound according to the present invention, i.e., Compound II-3, was added to the coating solution in an equimolar amount of the coupler to prepare Samples 3, 5, 7, 9 and 11, respectively.

These samples were exposed to light through an optical wedge and processed according to the following steps:

| Processing Step (33° C.) | |
|---|---|
| Color development | 3 min 30 sec |
| Bleach-fixing | 1 min 30 sec |
| Washing with water | 3 min |
| Drying (at 50° C. to 80° C.) | 2 min |

The composition of each processing solution is set forth below:

| | |
|---|---|
| Color Developer Solution | |
| Benzyl Alcohol | 12 ml |
| Diethylene Glycol | 5 ml |
| Potassium Carbonate | 25 g |
| Sodium Chloride | 0.1 g |
| Sodium Bromide | 0.5 g |
| Anhydrous Sodium Sulfite | 2 g |
| Hydroxyamine Sulfate | 2 g |
| Fluorescent Whitening Agent | 1 g |
| N—Ethyl-N—β- methanesulfonamidoethyl-3-methyl-4-aminoaniline Sulfate | 4 g |
| Water to make | 1 l |
| Sodium hydroxide was added to adjust the pH to 10.2 | |
| Bleach-Fixing Solution | |
| Ammonium Thiosulfate | 124.5 g |
| Sodium Metabisulfite | 13.3 g |
| Anhydrous Sodium Sulfite | 2.7 g |
| Iron (III) Ammonium Ethylenediaminetetraacetate | 65 g |
| Color Developer Solution (as described above) | 100 ml |
| Adjustment of pH to 6.7 to 6.8 | |
| Water to make | 1 l |

The development processing was carried out using a conventional roller transportation type development machine under normal replenishment procedure. Thus, the composition of the processing solutions used was in an equilibrium condition.

Then, the magneta reflective density in the unexposed area was measured using a Fuji type automatic recording densitometer setting Sample 1 as a standard. The results thus obtained are set forth in Table 1 below.

TABLE 1

| Sample | Magenta Coupler | Piperidine Compound | Magenta Density |
|---|---|---|---|
| 1 (Comparison) | 4-equivalent | — | (0.00) |
| 2 (Comparison) | I-19 | — | +0.13 |
| 3 (Present Invention) | I-19 | II-3 | +0.02 |
| 4 (Comparison) | I-20 | — | +0.24 |
| 5 (Present Invention) | I-20 | II-3 | +0.06 |
| 6 (Comparison) | I-36 | — | +0.14 |
| 7 (Present Invention) | I-36 | II-3 | +0.01 |
| 8 (Comparison) | I-44 | — | +0.10 |
| 9 (Present Invention) | I-44 | II-3 | +0.00 |
| 10 (Comparison) | I-46 | — | +0.16 |
| 11 (Present Invention) | I-46 | II-3 | +0.05 |

From the results shon in Table 1 it is apparent that the magenta stain fromed by development processing can be almost completely prevented by the combined use of the 2-equivalent magenta coupler and the piperidine compound according to the present invention.

EXAMPLE 2

On a paper support both surfaces of which were laminated with polyethylene were coated a first layer (undermost layer) to a sixth layer (uppermost layer) as shown in Table below in order to prepare a multilayer color photographic light-sensitive material which is designated Sample A. In the Table below the coating amounts are set forth in mg/m$^2$.

| | |
|---|---|
| Sixth Layer: (protective layer) | Gelatin (1,500 mg/m$^2$) |
| Fifth Layer: (red sensitive layer) | Silver chlorobromide emulsion (silver bromide: 50 mol %; silver: 250 mg/m$^2$)<br>Gelatin (1,500 mg/m$^2$)<br>Cyan coupler*1 (500 mg/m$^2$)<br>Coupler solvent*2 (250 mg/m$^2$) |
| Fourth Layer: (ultraviolet light-absorbing layer) | Gelatin (1,200 mg/m$^2$)<br>Ultraviolet light-absorbing agent*3 (700 mg/m$^2$)<br>Ultraviolet light-absorbing agent solvent*2 (250 mg/m$^2$) |
| Third Layer: (green-sensitive layer) | Silver chlorobromide emulsion (silver bromide: 70 mol %; silver: 350 mg/m$^2$)<br>Gelatin (1,500 mg/m$^2$)<br>Magenta coupler*4 (400 mg/m$^2$)<br>Coupler solvent*5 (400 mg/m$^2$) |
| Second Layer: (interlayer) | Gelatin (1,000 mg/m$^2$) |
| First Layer: (blue-sensitive layer) | Silver chlorobromide emulsion (silver bromide: 80 mol %; silver: 350 mg/m$^2$)<br>Gelatin (1,500 mg/m$^2$)<br>Yellow coupler*6 (500 mg/m$^2$)<br>Coupler solvent*2 (500 mg/m$^2$) |
| Support: | Paper support both surfaces of which were laminated with polyethylene [white pigment ($TiO_2$, etc.) and bluish dye (ultramarine blue, etc.) are incorporated into the polyethylene layer of the first layer side] |

*1Cyan coupler: 2-[α-(2,4-Di-tert-amylphenoxy)-butanamido]-4,6-dichloro-5-methyl-phenol
*2Coupler solvent: Trinonyl phosphate
*3Ultraviolet light-absorbing agent: 2-(2-Hydroxy-3-sec-butyl-5-tert-butylphenol)-benzotriazole
*4Magenta coupler: 1-(2,4,6-Trichlorophenyl)-3-(2-chloro-5-tetradecanamido)anilino-2-pyrazolin-5-one
*5Coupler solvent: Tri-o-cresyl phosphate
*6Yellow coupler: α-Pivaloyl-α-(2,4-dioxo-5,5'-dimethyloxazolidin-3-yl)-2-chloro-5-[α-(2,4-di-tert-amylphenoxy)-butanamido]acetanilide Sample B was prepared in the same manner as described in Sample A except that 500 mg/m$^2$ of Coupler I-42 as a magenta coupler and 175 mg/m$^2$ of the silver chlorobromide emulsion were used in the third layer. Further, 50 mol% of di-tert-octyl hydroquinone (comparison compound) per the coupler, 150 mg/m$^2$ of sulfinic acid polymer of the formula:

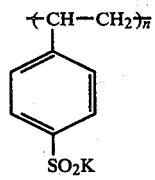

50 mol% of Compounds II-1, II-6 and II-7 according to the present invention were added to the third layer of Sample B to prepare Samples C, D, E, F and G, respectively.

These samples were exposed to light through an optical wedge and subjected to the same processing steps as described in Example 1. The magenta reflective density in the unexposed area was measured and a difference of density from that in Comparison Sample A was calculated. The results thus obtained are shown in Table 2 below.

TABLE 2

| Sample | Magenta Coupler | Additive | Magenta Density | Sensitivity* |
|---|---|---|---|---|
| A (Comparison) | 4-equivalent | — | (0.00) | 100 |
| B (Comparison) | I-43 | — | +0.17 | 91 |
| C (Comparison) | I-43 | Di-tert-octyl hydroquinone | +0.13 | 83 |
| D (Comparison) | I-43 | Sulfinic acid polymer | +0.15 | 87 |
| E (Present Invention) | I-43 | II-1 | +0.02 | 90 |
| F (Present Invention) | I-43 | II-6 | +0.00 | 92 |
| G (Present Invention) | I-43 | II-7 | +0.00 | 95 |

*Relative value when the sensitivity of Sample A is taken as 100.

It is apparent from the results shown in Table 2 that the compounds according to the present invention have an extremely good effect on preventing the formation of stain due to development processing of the photographic material containing 2-equivalent magenta couplers in comparison with known reducing agents such as a hydroquinone, etc. Furthermore, the compounds according to the present invention do not injure the photographic properties of the photographic light-sensitive materials.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having coated thereon a silver halide emulsion layer, the color photographic light-sensitive material containing a 2-equivalent magenta coupler represented by the following general formula (Ia):

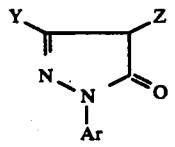

(Ia)

wherein Ar represents a phenyl group substituted with at least one halogen atom, an alkyl group having 1 to 22 carbon atoms, an alkoxy group having 1 to 22 carbon atoms, an alkoxycarbonyl group having 2 to 22 carbon atoms or a cyano group; Y represents an acylamino group having 1 to 32 carbon atoms or an anilino group having 6 to 44 carbon atoms; and Z represents a group capable of being released by coupling, and at least one kind of piperidine compound to prevent the occurrence of stain represented by the following general formula (II):

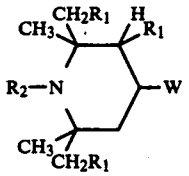

(II)

wherein $R_1$ represents a hydrogen atom or an alkyl group having from 1 to 4 carbon atoms; $R_2$ represents an alkyl group having from 1 to 12 carbon atoms, a hydroxyalkyl group having from 1 to 12 carbon atoms, an alkenyl group having from 3 to 4 carbon atoms, an alkynyl group having from 3 to 4 carbon atoms or a benzyl group; W represents a hydrogen atom, an alkyl group having 1 to 22 carbon atoms, a hydroxy group, a silyloxy group, an alkylamino group having 1 to 22 carbon atoms, an aryloxy group having 6 to 22 carbon atoms, an allyl group, an alkoxy group having 1 to 22 carbon atoms, an acylamino group having 1 to 22 carbon atoms, a sulfonamido group having 1 to 22 carbon atoms, an alkoxycarbonyl group having 2 to 23 carbon atoms, a carboxy group, an acyloxy group having 1 to 22 carbon atoms or a phosphoric acid oxy group.

2. A silver halide color photographic light-sensitive material as claimed in claim 1, wherein the group capable of being released by coupling represented by Z is a halogen atom.

3. A silver halide color photographic light-sensitive material as claimed in claim 1, wherein the group capable of being released by coupling represented by Z is a group releasing an oxygen atom.

4. A silver halide color photographic light-sensitive material as claimed in claim 1, wherein the group capable of being released by coupling represented by Z is a group releasing a nitrogen atom.

5. A silver halide color photographic light-sensitive material as claimed in claim 1, wherein the group capable of being released by coupling represented by Z is a group releasing a sulfur atom.

6. A silver halide color photographic light-sensitive material as claimed in claim 1, wherein the 2-equivalent magenta coupler represented by the general formula (Ia) is represented by the following general formula (Ib):

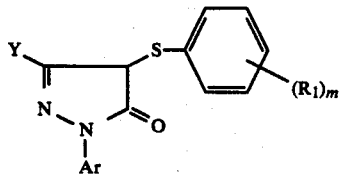

(Ib)

wherein Ar represents a phenyl group substituted with at least one halogen atom, an alkyl group having 1 to 22 carbon atoms, an alkoxy group having 1 to 22 carbon atoms, an alkoxycarbonyl group having 2 to 22 carbon atoms or a cyano group; $R_1$ represents a hydrogen atom, a halogen atom, an acylamino group having 1 to 22 carbon atoms, a sulfonamido group having 1 to 22 carbon atoms, a carbamoyl group having 1 to 22 carbon atoms, a sulfamoyl group having 1 to 22 carbon atoms, an alkylthio group having 1 to 22 carbon atoms, an alkoxycarbonyl group having 2 to 22 carbon atoms, a hydroxy group, an alkyl group having 1 to 22 carbon atoms, an alkoxy group having 1 to 22 carbon atoms, or an aryl group having 6 to 22 carbon atoms; m represents an integer of 1 to 5; Y represents an acylamino group having 1 to 32 carbon atoms or an anilino group having 6 to 44 carbon atoms; and when m is 2 or more, $R_1$ may be the same or different.

7. A silver halide color photographic light-sensitive material as claimed in claim 6, wherein the 2-equivalent magenta coupler represented by the general formula (Ib) is represented by the following general formula (Ic):

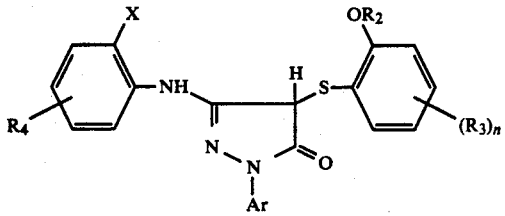

(Ic)

wherein Ar represents a phenyl group substituted with at least one halogen atom, an alkyl group having 1 to 22 carbon atoms, an alkoxy group having 1 to 22 carbon atoms, an alkoxycarbonyl group having 2 to 23 carbon atoms or a cyano group; $R_2$ represents an alkyl group having 1 to 22 carbon atoms or an aryl group having 6 to 22 carbon atoms; X represents a halogen atom or an alkoxy group having 1 to 22 carbon atoms; $R_3$ represents a hydrogen atom, a hydroxy group, a halogen atom, an alkyl group having 1 to 36 carbon atoms, an alkoxy group having 1 to 36 carbon atoms or an aryl group having 6 to 38 carbon atoms; $R_4$ represents a hydrogen atom, a halogen atom, an alkyl group having 1 to 36 carbon atoms, an alkoxy group having 1 to 36 carbon atoms, an acylamino group having 1 to 36 carbon atoms, a sulfonamido group having 1 to 36 carbon atoms, a sulfamoyl group having 1 to 36 carbon atoms, a carbamoyl group having 1 to 36 carbon atoms, a diacylamino group having 1 to 36 carbon atoms in each acyl moiety, an alkoxycarbonyl group having 2 to 36 carbon atoms, an alkoxysulfonyl group having 1 to 36 carbon atoms, an aryloxysulfonyl group having 6 to 38 carbon atoms, an alkanesulfonyl group having 1 to 36 carbon atoms, an arylsulfonyl group having 6 to 38 carbon atoms, an alkylthio group having 1 to 36 carbon atoms, an arylthio group having 6 to 38 carbon atoms, an alkyloxycarbonylamino group having 2 to 36 carbon atoms, an alkylureido group having 1 to 36 carbon atoms, an acyl group having 1 to 36 carbon atoms, a nitro group, a carboxy goup, or a trichloromethyl group; and n is an integer of from 1 to 4.

8. A silver halide color photographic light-sensitive material as claimed in claim 7, wherein the alkyl group represented by $R_2$ is an alkyl group having from 1 to 22 carbon atoms.

9. A silver halide color photographic light-sensitive material as claimed in claim 7, wherein the total number of carbon atoms included in the groups represented by $R_2$ and $R_3$ is not less than 6.

10. A silver halide color photographic light-sensitive material as claimed in claim 1, wherein an amount of the piperidine compound represented by the general formula (II) to the amount of the 2-equivalent magenta coupler represented by the general formula (Ia) is from 5 mol% to 500 mol%.

11. A silver halide color photographic light-sensitive material as claimed in claim 1, wherein an amount of the piperidine compound represented by the general formula (II) to the amount of the 2-equivalent magenta coupler represented by the general formula (Ia) is from 20 mol% to 100 mol%.

12. A silver halide color photographic light-sensitive material as claimed in claim 1, wherein the 2-equivalent magenta coupler represented by the general formula (Ia) and the piperidine compound represented by the general formula (II) are present in the same layer.

13. A silver halide color photographic light-sensitive material as claimed in claim 1, wherein the 2-equivalent magenta coupler represented by the general formula (Ia) and the piperidine compound represented by the general formula (II) are present in a silver halide emulsion layer.

14. A silver halide color photographic light-sensitive material as claimed in claim 13, wherein the silver halide emulsion layer is a green-sensitive silver halide emulsion layer.

15. A silver halide color photographic light-sensitive material as claimed in claim 14, wherein the photographic material further contains a blue-sensitive silver halide emulsion layer containing a yellow color-forming coupler and a red-sensitive silver halide emulsion layer containing a cyan color-forming coupler.

16. A silver halide color photographic light-sensitive material as claimed in claim 15, wherein the photographic material is a color printing paper.

17. A silver halide color photographic light-sensitive material as claimed in claim 12, wherein the 2-equivalent magenta coupler and the piperidine compound are present in a droplet of an organic solvent having a melting point of not less than 180° C. dispersed in a hydrophilic colloid.

18. A silver halide color photographic light-sensitive material as claimed in claim 17, wherein the organic solvent is a phosphoric acid ester.

19. A silver halide color photographic light-sensitive material as claimed in claim 17, wherein the hydrophilic colloid is gelatin.

20. A method of forming a color image comprising developing an imagewise exposed silver halide color photographic light-sensitive material comprising a support having coated thereon at least one silver halide emulsion layer, the color photographic light-sensitive material containing at least one kind of 2-equivalent magenta coupler represented by the following general formula (Ia):

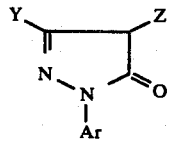

(Ia)

wherein Ar represents a phenyl group substituted with at least one halogen atom, an alkyl group having 1 to 22 carbon atoms, an alkoxy group having 1 to 22 carbon atoms, an alkoxycarbonyl group having 2 to 23 carbon atoms or a cyano group; Y represents an acylamino group having 1 to 32 carbon atoms or an anilino group having 6 to 44 carbon atoms; and Z represents a group capable of being released by coupling, and at least one kind of piperidine compound to prevent the occurrence of stain represented by the following general formula (II):

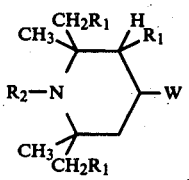

(II)

wherein $R_1$ represents a hydrogen atom or an alkyl group having from 1 to 4 carbon atoms; $R_2$ represents an alkyl group having from 1 to 12 carbon atoms, a hydroxyalkyl group having from 1 to 12 carbon atoms, an alkenyl group having from 3 to 4 carbon atoms, an alkynyl group having from 3 to 4 carbon atoms or a benzyl group; W represents a hydrogen atom, an alkyl group having 1 to 22 carbon atoms, a hydroxy group, a silyloxy group, an alkylamino group having 1 to 22 carbon atoms, an aryloxy group having 6 to 22 carbon atoms, an allyl group, an alkoxy group having 1 to 22 carbon atoms, an acylamino group having 1 to 22 carbon atoms, a sulfonamido group having 1 to 22 carbon atoms, an alkoxycarbonyl group having 2 to 23 carbon atoms, a carboxy group, with an aqueous alkaline solution containing a color developing agent.

21. A method of forming a color image as claimed in claim 20, wherein the photographic material is, after color development, processed in a bleach-fixing solution.

22. A method of forming a color image as claimed in claim 20, wherein the color development step and the bleach-fixing step are carried out continuously.

* * * * *